US009650801B2

(12) United States Patent
Mouyiaris et al.

(10) Patent No.: US 9,650,801 B2
(45) Date of Patent: May 16, 2017

(54) PORTABLE BARRIER

(71) Applicant: Nikos Mouyiaris, Long Island City, NY (US)

(72) Inventors: Nikos Mouyiaris, Long Island City, NY (US); Qizhong Guo, Belle Mead, NJ (US)

(73) Assignee: Nikos Mouyiaris, Long Island City, NY (US)

( * ) Notice: Subject to any disclaimer, the term of this patent is extended or adjusted under 35 U.S.C. 154(b) by 0 days.

(21) Appl. No.: 14/815,394

(22) Filed: Jul. 31, 2015

(65) Prior Publication Data

US 2015/0337512 A1 Nov. 26, 2015

Related U.S. Application Data

(63) Continuation of application No. 14/301,585, filed on Jun. 11, 2014, now Pat. No. 9,103,135, which is a continuation-in-part of application No. 13/827,006, filed on Mar. 14, 2013, now Pat. No. 8,769,880, which is a continuation-in-part of application No. 13/493,831, filed on Jun. 11, 2012, now abandoned, (Continued)

(51) Int. Cl.

| | |
|---|---|
| ***E04H 9/14*** | (2006.01) |
| ***E02B 3/10*** | (2006.01) |
| *E04B 2/02* | (2006.01) |

(52) U.S. Cl.

CPC ..... *E04H 9/145* (2013.01); *E02B 3/108* (2013.01); *E04B 2002/0215* (2013.01)

(58) Field of Classification Search

CPC ..... E02B 3/108; E02B 3/102; E02B 3/106; E02B 7/005; E02B 3/10; E02B 3/04; E02B 3/104; E02B 7/14; E04H 9/145; E04H 2015/204; E04H 2015/206; E04H 15/20; E04B 2002/0215

USPC ..... 405/107, 110–115; 52/2.11, 2.17, 2.19, 52/2.21, 2.22, 79.5, 309.2, 578

See application file for complete search history.

(56) References Cited

U.S. PATENT DOCUMENTS

| | | | |
|---|---|---|---|
| 2,916,058 | A | 12/1959 | Unthank |
| 3,205,106 | A | 9/1965 | Cross |

(Continued)

FOREIGN PATENT DOCUMENTS

| | | | |
|---|---|---|---|
| CA | 2229525 | A1 | 8/1999 |
| JP | 2001317018 | A | 11/2001 |

(Continued)

OTHER PUBLICATIONS

English translation of First Office Action and CN Search Report, in related Chinese application No. CN 200880105583.7, dated Feb. 5, 2013.

(Continued)

*Primary Examiner* — Brian Glessner
*Assistant Examiner* — Adam Barlow
(74) *Attorney, Agent, or Firm* — Crawford Maunu PLLC

(57) ABSTRACT

A portable and collapsible barrier that is lightweight and can be easily transported and erected. The barrier includes a base, a top and an enclosed volume such as a diaphragm that can be expanded with a medium such as a gas or liquid to a desired shape. The expanded volume will act as a barrier. When a series of expanded barriers are connected, they will form a wall that can contain bulk materials or liquids.

21 Claims, 10 Drawing Sheets

Related U.S. Application Data which is a continuation of application No. 11/899,640, filed on Sep. 7, 2007, now Pat. No. 8,196,357, application No. 14/815,394, which is a continuation of application No. PCT/US2014/028623, filed on Mar. 14, 2014.

(56) References Cited

U.S. PATENT DOCUMENTS

| | | | | |
|---|---|---|---|---|
| 3,227,169 | A | 1/1966 | Fischer | |
| 3,390,491 | A | 7/1968 | Hayden et al. | |
| 3,629,875 | A | 12/1971 | Dow | |
| 3,936,984 | A | 2/1976 | Yando | |
| 4,006,702 | A | 2/1977 | St. Cyr | |
| 4,267,662 | A | 5/1981 | Gordy | |
| 4,607,655 | A | 8/1986 | Wagner et al. | |
| 4,824,282 | A | 4/1989 | Waldecker | |
| 4,842,442 | A * | 6/1989 | Caulfield | E02B 3/06 405/284 |
| 5,269,623 | A | 12/1993 | Hanson | |
| 5,493,816 | A * | 2/1996 | Willemsen | A63H 33/04 446/104 |
| 5,720,678 | A | 2/1998 | Korthauer | |
| 5,832,687 | A | 11/1998 | Willemsen | |
| 6,012,872 | A * | 1/2000 | Perry | E02B 3/108 220/1.6 |
| 6,200,067 | B1 | 3/2001 | Pena | |
| 6,223,903 | B1 | 5/2001 | Monsouri | |
| 6,332,290 | B1 | 12/2001 | Delamare | |
| 6,334,736 | B1 | 1/2002 | Johnson et al. | |
| 6,450,733 | B1 * | 9/2002 | Krill | E02B 3/102 405/107 |
| 6,467,221 | B1 | 10/2002 | Bigelow | |
| 6,641,329 | B1 | 11/2003 | Clement | |
| 7,712,998 | B2 * | 5/2010 | Salemie | E02B 3/108 256/13 |
| 7,963,075 | B2 | 6/2011 | Howland | |
| 8,028,476 | B1 * | 10/2011 | Alford | E04H 4/0043 248/188.2 |
| 2004/0040971 | A1 | 3/2004 | Athalye | |
| 2004/0047688 | A1 | 3/2004 | Clement | |
| 2007/0237586 | A1 | 10/2007 | Prestininzi | |
| 2007/0243021 | A1 | 10/2007 | Tyler | |
| 2008/0087676 | A1 | 4/2008 | Kasboske | |
| 2008/0190032 | A1 | 8/2008 | Roelofs | |
| 2013/0017018 | A1 * | 1/2013 | Allen | E02D 27/01 405/114 |
| 2014/0105687 | A1 * | 4/2014 | Southworth | E02B 7/02 405/107 |
| 2014/0369760 | A1 * | 12/2014 | Venton | E02B 7/22 405/114 |

FOREIGN PATENT DOCUMENTS

| | | | |
|---|---|---|---|
| SU | 1659568 | A1 | 6/1991 |
| SU | 1784025 | A3 | 12/1992 |
| WO | 2005/090898 | A1 | 9/2005 |

OTHER PUBLICATIONS

EPO Search Opinion, in related European application No. EP 08 829 845.0, completed Sep. 13, 2012.

EPO Supplementary Search Report, in related European application No. EP 08 829 845.0, completed Sep. 13, 2012.

Decision of grant of patent for invention, with Conclusion on the results of the examination, in related Russian application No. RU 2010107410/03, dated Feb. 26, 2014.

International Preliminary Report on Patentability and Written Opinion, in related international application No. PCT/US2008/010408, issued Mar. 9, 2010.

International Search Report, in related international application No. PCT/US2008/010408, mailed Nov. 25, 2008.

USPTO's Non-Final Office Action with PTO-892, in related U.S. Appl. No. 11/899,640, dated Nov. 10, 2011.

USPTO's Notice of Allowance and Allowability with PTO-892, in related U.S. Appl. No. 11/899,640, dated May 21, 2012.

USPTO's Non-Final Office Action with PTO-892, in related U.S. Appl. No. 13/827,006, dated Sep. 11, 2013.

USPTO's Notice of Allowance and Allowability with PTO-892, in related U.S. Appl. No. 13/827,006, dated Jun. 26, 2014.

International Search Report, in related international application No. PCT/US2014/028623, mailed Aug. 7, 2014.

International Preliminary Report on Patentability and Written Opinion, in related international application No. PCT/US2014/028623, mailed Aug. 7, 2014.

* cited by examiner

Fig. 10A
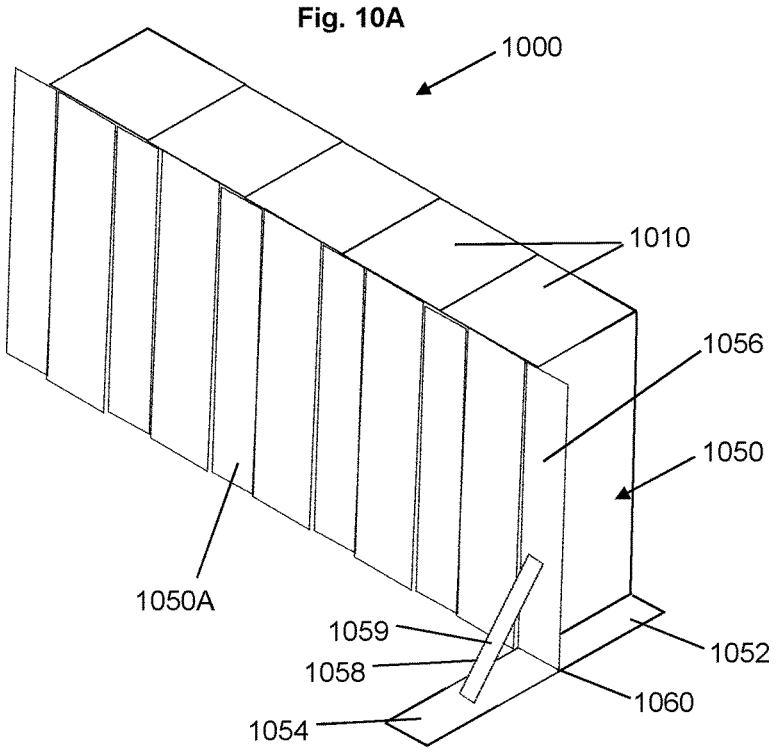
Fig. 10
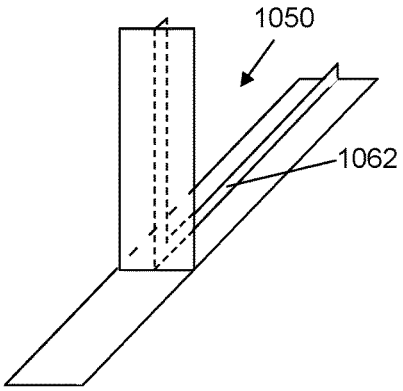
Fig. 10B
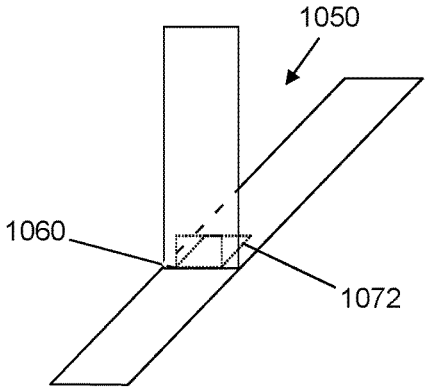
Fig. 10C

PORTABLE BARRIER

CROSS-REFERENCE TO RELATED CASES

This patent application is a continuation of and claims the benefit of priority to U.S. patent application Ser. No. 14/301,585, filed Jun. 11, 2014, which in turn is a continuation-in-part of and claims the benefit of priority to U.S. patent application Ser. No. 13/827,006, filed Mar. 14, 2013 and issued on Jul. 8, 2014 as U.S. Pat. No. 8,769,880, which in turn is a continuation-in-part of U.S. patent application Ser. No. 13/493,831, filed Jun. 11, 2012, now abandoned, which in turn is a continuation of U.S. patent application Ser. No. 11/899,640, filed Sep. 7, 2007, and issued on Jun. 12, 2012 as U.S. Pat. No. 8,196,357.

This patent application is a continuation of and claims the benefit of priority to International Application No. PCT/US14/28623, filed Mar. 14, 2014, which in turn is a continuation-in-part of and claims the benefit of priority to U.S. patent application Ser. No. 13/827,006, filed Mar. 14, 2013 and issued on Jul. 8, 2014 as U.S. Pat. No. 8,769,880, which in turn is a continuation-in-part of U.S. patent application Ser. No. 13/493,831, filed Jun. 11, 2012, now abandoned, which in turn is a continuation of U.S. patent application Ser. No. 11/899,640, filed Sep. 7, 2007, and issued on Jun. 12, 2012 as U.S. Pat. No. 8,196,357.

Each of the aforementioned patents and patent applications is incorporated by reference herein in its entirety for any purpose whatsoever.

BACKGROUND OF THE DISCLOSURE

Field of the Disclosure

The embodiments described herein relate to a portable and collapsible barrier unit that is lightweight and can be easily transported and erected. The barrier unit includes a diaphragm that can be expanded with a medium to a desired shape that will act as a barrier. Each barrier unit can be used alone or with other barrier units to create a wall.

Description of the Related Art

Different types of portable barriers exist for different situations. For example, saw horses or metal gates are sometimes used to contain crowds. A problem with saw horses, metal gates and other similar barriers is they can not contain bulk materials and liquids such as soil, grain or water. Such bulk materials and liquids require barriers that, for example, can span large distances, can hold back the weight of bulk materials and liquids and do not have any holes that would allow the bulk materials or liquids to pass through the barrier.

SUMMARY OF THE DISCLOSURE

The embodiments described herein include a portable, collapsible, lightweight barrier unit. Each barrier unit has a rigid base, which can be a carrying case with a top, and an inflatable enclosed volume such as a flexible diaphragm that rests on the base. The side walls of the volume can have any constructions such as an accordion-like construction. The volume can be secured to the base. The volume will have an inlet hole through which a medium such as a gas or liquid can be pumped into the volume to inflate the volume. When the volume is inflated, the volume will act as a barrier for holding back bulk materials or liquids. Each barrier unit can be anchored using, for example, ballast.

A number of barrier units can be connected together to form a wall or corral. The barriers can be connected using any conventional techniques. The barrier units can be sealed together using any conventional technique to prevent bulk materials or liquids from seeping between the barrier units. The barrier units can also be sealed to the ground to prevent the bulk materials or liquids from seeping underneath the barrier units. Each enclosed volume of each barrier unit can be connected to separate mediums sources or can be connected in parallel to the same medium source. In addition, the volumes of the barrier units can be connected in series so the medium enters one volume to inflate that volume and then can exit that volume and enter the next volume to inflate that volume and then continue on to the other volumes.

BRIEF DESCRIPTION OF DRAWINGS

The accompanying drawings illustrate the embodiments described herein and, together with the Detailed Description below, help to describe the embodiments. The reference numerals in the drawings refer to the same or like elements and are used in the Detailed Description to refer to the same or like elements. Below are brief descriptions of the drawings:

FIGS. 10A-10C illustrate still further exemplary embodiments in accordance with the disclosure.

DETAILED DESCRIPTION OF THE PREFERRED EMBODIMENTS

Figure 1:
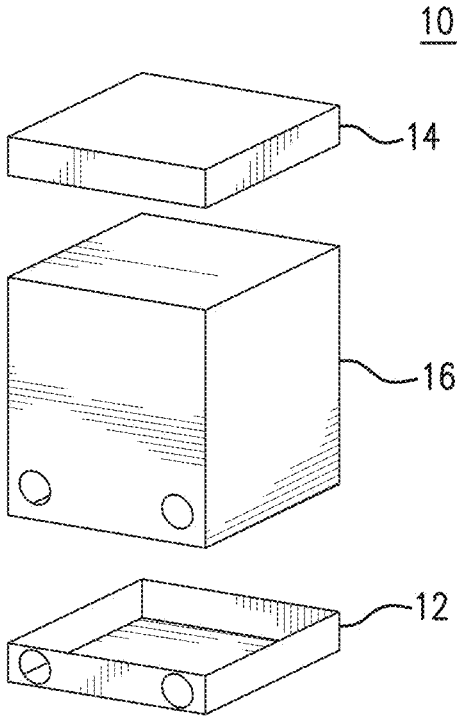
FIG. 1 is an exploded view of the portable barrier unit in accordance with an embodiment of the present disclosure.

FIG. 1 illustrates several components of a portable barrier unit 10. Barrier unit 10 consists of a rigid base 12, a rigid top 14 and an expandable volume or flexible diaphragm 16.

Figure 2:
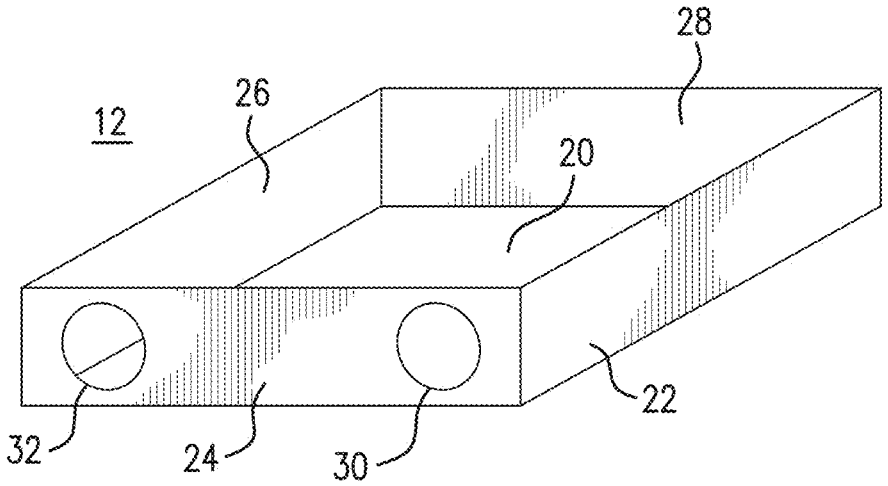
FIG. 2 is a perspective view the base of the portable barrier unit in accordance with an embodiment of the present disclosure.

FIG. 2 illustrates base 12. Base 12 has a bottom 20 and four side walls 22, 24, 26, 28, all of which form a tray-like structure with an open top. Side wall 24 has an inlet hole 30 and an outlet hole 32.

Figure 3:
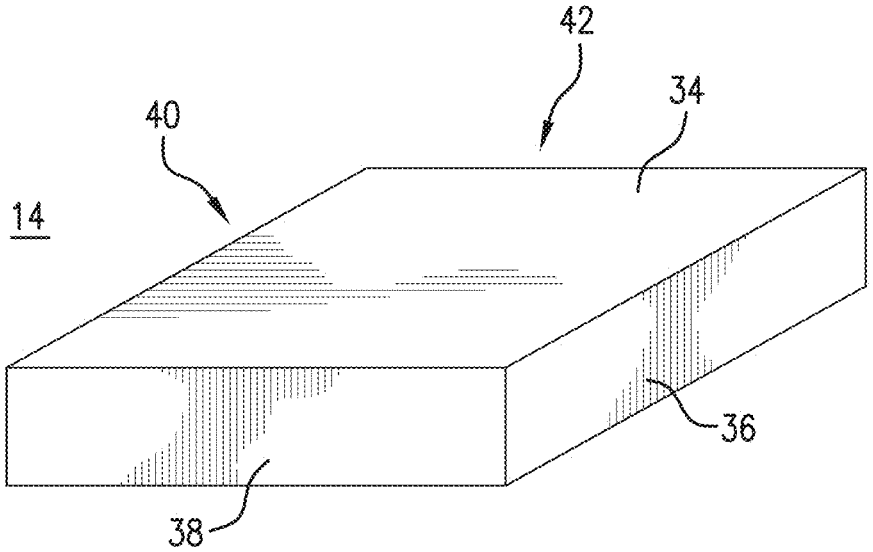
FIG. 3 is a perspective view the top of the portable barrier unit in accordance with an embodiment of the present disclosure.

FIG. 3 illustrates top 14. Top 14 has a top 34 and four side walls 36, 38, 40, 42, all of which form an upside down tray-like structure with an open bottom.

Base 12 and top 14 can be made out of any lightweight, rigid material. One such material is plastic. In addition, base 12 and top 14 can be of any construction that will allow the expandable volume or flexible diaphragm 16 to easily expand or inflate without tipping over. Both base 12 and top 14 can be of any construction as long as they help to stabilize the expandable volume or flexible diaphragm 16 while it expands or inflates. The base 12 and/or other surfaces of the barrier can be further provided with a high friction layer 11 to enhance the gripping between the base and the ground, or between adjacent barriers. Such a material can include rubber, synthetic rubber, elastomeric material, and the like. Enhancing the gripping force between the barrier and the ground, and/or other barriers can result in the barriers being able to resist greater forces, or permitting smaller barriers to be used for a given force.

Base 12 and top 14 can be designed to act as a carrying case for the expandable volume or flexible diaphragm 16. In such case, the side walls 22, 24, 26, 28 of base 12 may fit over or engage the side walls 36, 38, 40, 42 of top 14 in any conventional manner. For example, side walls 22, 24, 26, 28 may have a male lip around their top edges and side walls 36, 38, 40, 42 may have a female lip around their top edges. When top 14 is placed on base 12, the two sets of lips engage one another to hold top 14 and base 12 together. Another example is each side wall 22, 24, 26, 28 may have a male portion of a latch at their top edges and each side wall 36, 38, 40, 42 may have a female portion of a latch at their top edges. When top 14 is placed on base 12, the two sets of side walls abut against one another and the latches, when engaged, hold top 14 and base 12 together.

Figure 4:
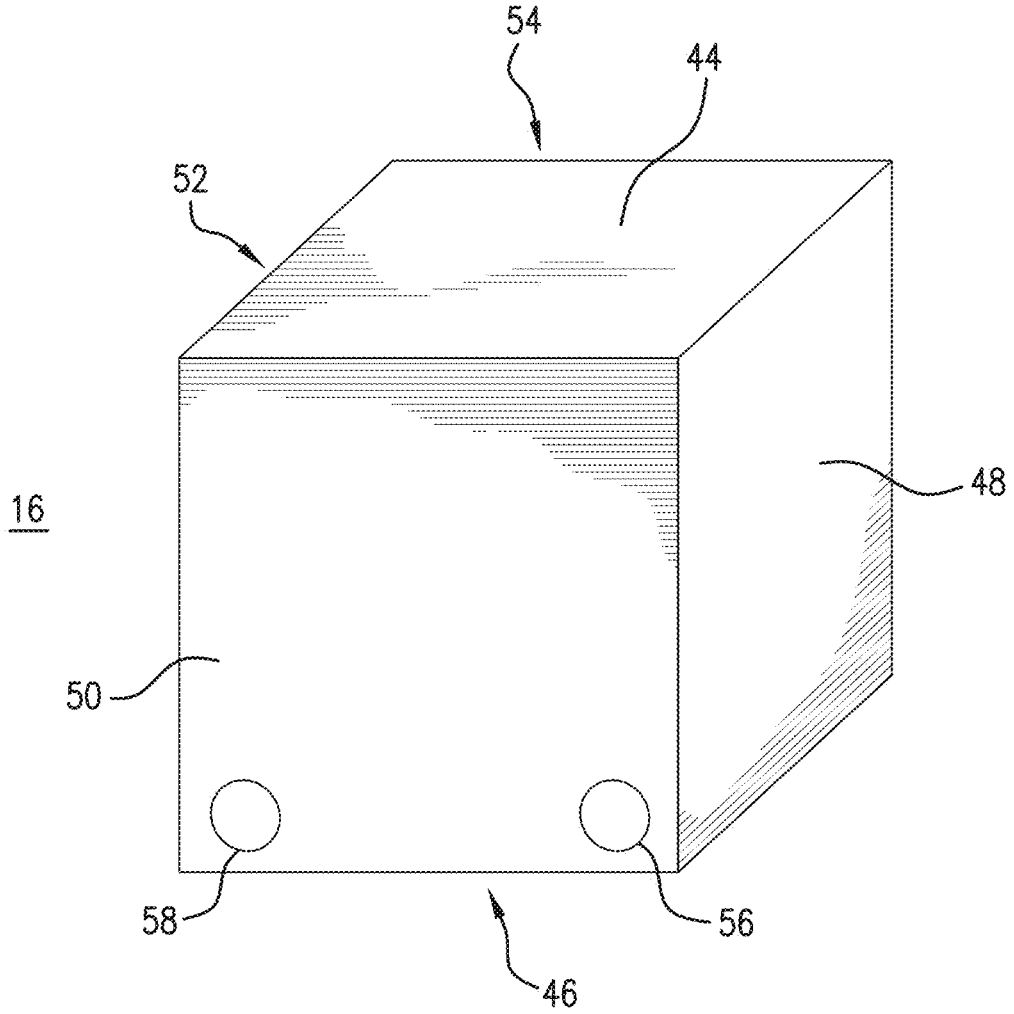
FIG. 4 is a perspective view the diaphragm of the portable barrier unit in accordance with an embodiment of the present disclosure.

FIG. 4 illustrates the expandable volume or flexible diaphragm 16. Diaphragm 16 forms an enclosed volume by itself of in conjunction with the base 12 and top 14. Diaphragm 16 can be an enclosed box shape with a top 44, a bottom 46 (not shown) and four side walls 48, 50, 52 (not shown), 54 (not shown). In addition, diaphragm 16 can have an inlet hole 56 and an outlet hole 58. In some embodiments, diaphragm 16 may not have a top 44 or a bottom 46. Diaphragm 16 is made out of any material that is flexible and that can expand but is preferably a lightweight material such as vinyl.

The bottom of diaphragm 16 fits into or is secured to base 12 and the top of diaphragm 16 fits into or is secured to top 14. Diaphragm 16 can be secured into base 12 and top 14 using any conventional means such as fasteners, glue or form fit techniques. If side walls 48, 50, 52, 54 of diaphragm 16 are sealed to side walls 22, 24, 26, 28 of base 12 and side walls 36, 38, 40, 42 of top 14, then diaphragm 16 does not need its top 44 or bottom 46 since top 14 and base 12 will acts as the top and bottom of diaphragm 16.

When the bottom of diaphragm 16 is inserted into base 12, inlet hole 56 and outlet hole 58 of diaphragm 16 will line up with inlet hole 30 and outlet hole 32 of base 12, respectively. Inlet hole 56 and outlet hole 58 of diaphragm 16 and inlet hole 30 and outlet hole 32 of base 12 will be connected and sealed together using any conventional means. For example, inlet hole 56 and outlet hole 58 of diaphragm 16 may have extra material that is pulled through inlet hole 30 and outlet hole 32 of base 12, respectively, and a ring is placed around inlet hole 30 and outlet hole 32 of base 12. Another example is inlet hole 56 and outlet hole 58 of diaphragm 16 may have extra material that is pulled through inlet hole 30 and outlet hole 32 of base 12, respectively, and glued to side 24 of base 12.

The cross-sectional shape of barrier unit 10 and, thus, of base 12, top 14 and expandable volume or flexible diaphragm 16, is a square. The cross-sectional shape of barrier unit 10, however, can be any shape such as a circle, oval, rectangle, triangle or any other polygon or circular shape.

Expandable volume or flexible diaphragm 16 is an enclosed volume that acts like a balloon. Diaphragm 16 begins in a collapsed state. A medium such as water or air (not shown) is pumped into inlet hole 30 using any conventional means such as a pump or air compressor. Outlet hole 32 is closed or topped using any conventional means so that the interior of diaphragm 16 is sealed and no medium can escape from outlet hole 32. As more and more medium enters the interior of diaphragm 16, diaphragm 16 will expand or inflate. When diaphragm 16 has fully expanded, diaphragm 16 will form a rectangular column, as shown in FIG. 1.

Figure 5:
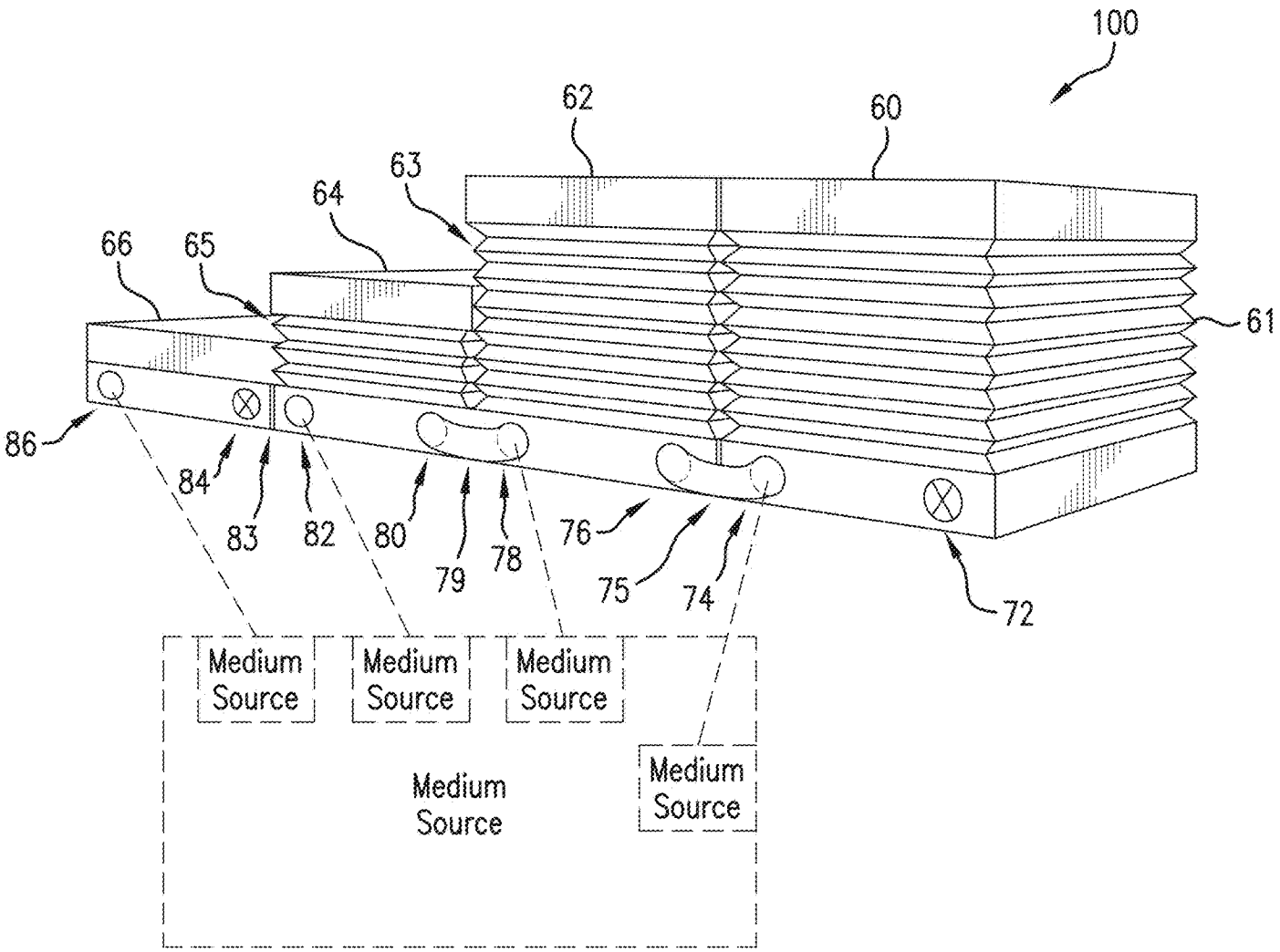
FIG. 5 is a perspective view of a series of portable barrier units in accordance with an embodiment of the present disclosure.

Expandable volume or flexible diaphragm 16 can be of any construction that will allow diaphragm 16 to be carried inside base 12 and top 14 and to expand upward. As shown in FIGS. 1-4, diaphragm 16 is a box shape constructed of flexible material. FIG. 5 illustrates a number of barriers with diaphragms that have accordion-like side walls. As shown in FIG. 5, barrier unit 60 has an accordion-like diaphragm 61, barrier unit 62 has an accordion-like diaphragm 63, and barrier unit 64 has an accordion-like diaphragm 65. Barrier unit 66 also has an accordion-like diaphragm but the diaphragm is not shown since barrier unit 66's top is on its base in a closed position. The accordion-like diaphragms can be made of any material that are flexible enough to expand but stiff enough to fold up in an accordion-like fashion. In addition, the accordion-like diaphragms can be constructed without a bottom and a top in a manner previously described above. If the diaphragms do not have a top or bottom, the sides of the diaphragms will need to be secured and sealed to the bases and tops to create an enclosed volume.

In operation, barrier unit 10 is transported in a closed position. Next, barrier unit 10 is placed in a site where a barrier needs to be erected. Next, a medium such as water or air (not shown) is pumped into inlet holes 30, 56 using any conventional means such as a pump or air compressor while outlet holes 32, 58 are closed or topped using any conventional means so that the interior of expandable volume or flexible diaphragm 16 is sealed and no medium can escape from outlet holes 32, 58. As more and more medium enters the interior of diaphragm 16, diaphragm 16 will begin to expand or inflate. As diaphragm 16 expands, diaphragm 16 will lift top 14 upwards off of base 12. When diaphragm 16 has fully expanded, the pumping of the medium is stopped. When use of the barrier is complete, the medium is let out of diaphragm 16 by opening outlet holes 32, 58. When diaphragm 16 is collapsed, diaphragm 16 is packed into base 12, and top 14 is placed back onto base 12. Thus, barrier unit 10 can be transported to another site and reused.

Any medium can be used as long as it is suitable for the intended use of barrier unit 10. For example, air as a medium may not be heavy enough to allow barrier unit 10 to hold back heavy bulk products such as coal. In such cases, the barrier unit 10 can be anchored using conventional techniques such as using rocks or weights as ballast in base 12 to hold barrier unit 10 in place. Alternatively, a heavier medium such as water can be used and ballast may not be necessary. Inlet holes 30, 56 and outlet holes 32, 58 can be connected to any type of valve and/or pump depending on the use of barrier unit 10 and the medium pumped into barrier unit 10.

FIG. 5 illustrates a number of barrier units connected together in series to form a barrier system or wall 100. Barrier unit 60 is placed next to barrier unit 62. Barrier unit 62 is placed next to barrier unit 64. Barrier unit 64 is placed next to barrier unit 66. The barriers can be connected to one another using any conventional means such as latches, tape or straps.

Figure 6:
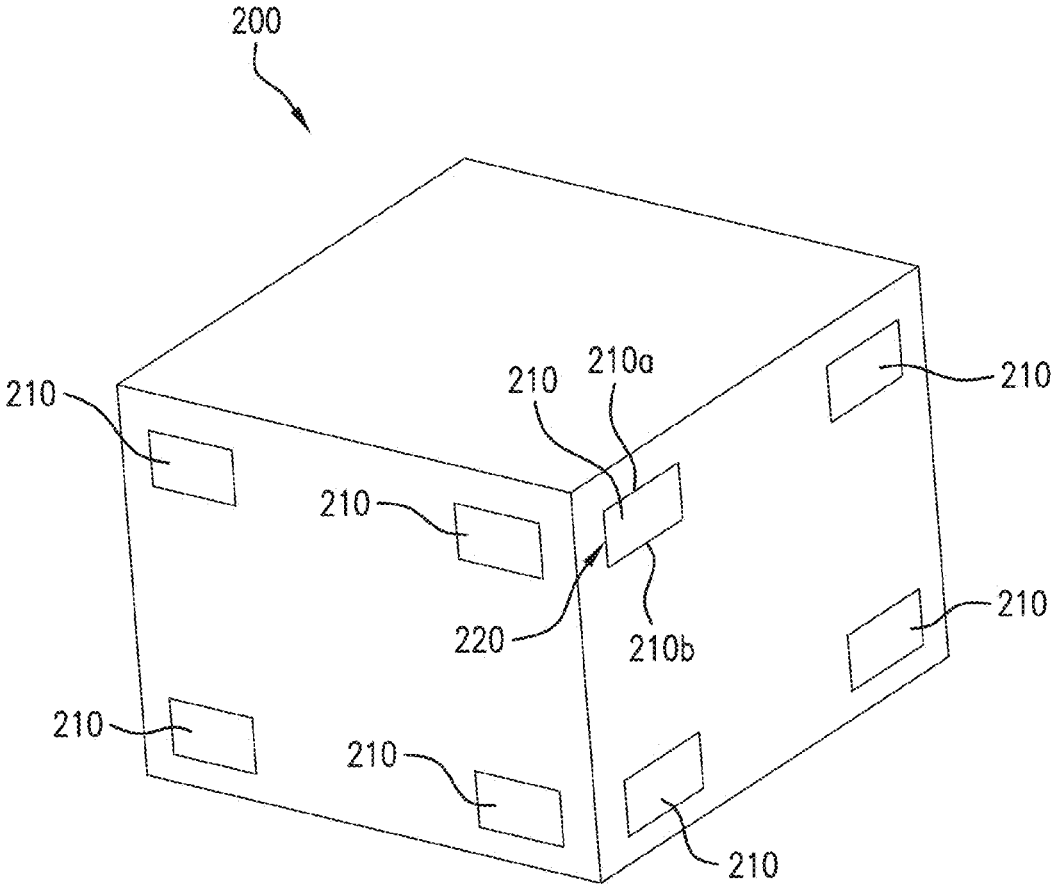
FIG. 6 is a perspective view of an alternative embodiment of a portable barrier unit in accordance with the disclosure.

For example, as illustrated in FIG. 6, an alternative embodiment of a portable barrier unit 200 is illustrated.

Figure 7:
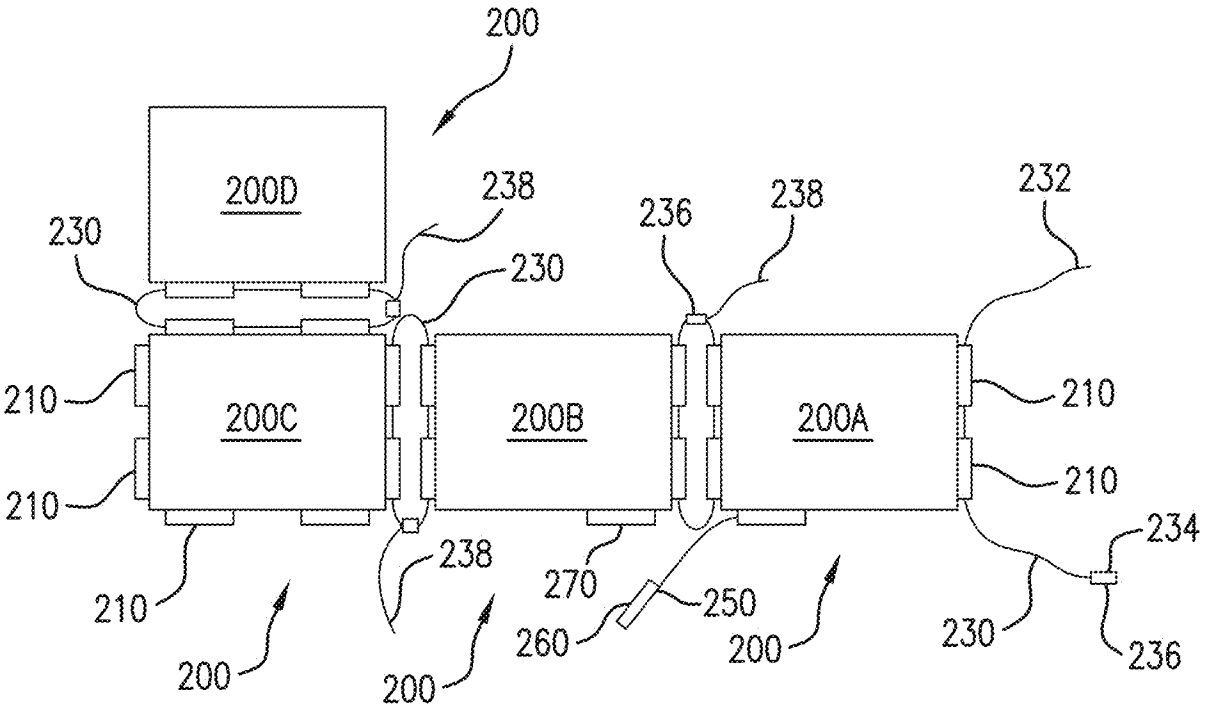
FIG. 7 is a top view of a series of assembled portable barrier units in accordance with the disclosure.

While similar to the earlier embodiment, the illustrated embodiment includes a plurality of sleeves or conduits 210 having upper and lower peripheries 210*a*, 210*b* that are attached to the sidewall of the barrier unit 200. FIG. 7 illustrates a top view of a plurality of portable barrier units 200 each equipped with sleeves 210 on at least two vertical faces. For example, units 200A and 200B have four outwardly facing sleeves on each of two sides arranged in a manner as illustrated in FIG. 6, such that each of units 200A and 200B have eight sleeves. Unit 200C has four sleeves on each vertical face, while barrier 200*d* has four sleeves 210 on only one vertical face. It will be appreciated that while four sleeves are illustrated in two rows of two sleeves, any suitable number of sleeves in any suitable number of rows may be used.

With further reference to FIG. 7, adjacent barrier units 200 are connected to each other via straps 230 that are routed through adjacent sleeves 210 of successive barrier units 200. As illustrated, each strap 230 has a first end 232, a second end 234, and a buckle 236. Thus, unit 200A is connected to unit 200B via one or more straps 230 that are routed through sleeves on the top of each barrier unit 200 and/or on the bottom of each barrier unit 200. Extra strap 238 that passes through the buckle can be left hanging or can be tucked back into a nearby sleeve 210, as desired. Units 200B and 200C are attached in a manner similar to units 200A and 200B, while units 200C and 200D are attached along a direction that is generally orthogonal to the linear arrangement of units 200A, 200B and 200C.

It will be appreciated that a variety of other fixation techniques can be used to attach units 200 to each other, such as hook and loop fasteners on the barrier units themselves, or on large straps (e.g., 250) including hook and loop fastener 260 that mates with a landing area 270 on an adjacent barrier unit as illustrated in FIG. 7.

In one embodiment, barriers can be filled and then attached to an unfilled barrier unit by way of the fastener (e.g., straps). The newly attached unfilled barrier can be filled, and then the process can be repeated to form the entire barrier system.

In operation, barriers 60, 62, 64 and 66's inlet and outlet holes are connected to allow the medium to flow from one diaphragm to another diaphragm. Inlet hole 72 of barrier unit 60 is connected to a source of a medium such as a water pump using any conventional means such as a pipe. As the medium is pumped into expandable volume or flexible diaphragm 61 of barrier unit 60, diaphragm 61 will expand.

Outlet hole 74 of barrier unit 60 is connected to inlet hole 76 of barrier unit 62 by a pipe 75. As the medium is pumped into expandable volume or flexible diaphragm 61 of barrier unit 60, at some point such as when diaphragm 61 is fully expanded, the medium will flow through pipe 75 into expandable volume or flexible diaphragm 63 of barrier unit 62.

Outlet hole 78 of barrier unit 62 is connected to inlet hole 80 of barrier unit 64 by a pipe 79. As the medium is pumped into expandable volume or flexible diaphragm 63 of barrier unit 62, at some point such as when diaphragm 63 is fully expanded, the medium will flow through pipe 79 into expandable volume or flexible diaphragm 65 of barrier unit 64.

Outlet hole 82 of barrier unit 64 is connected to inlet hole 84 of barrier unit 66 by a pipe 83. As the medium is pumped into expandable volume or flexible diaphragm 65 of barrier unit 64, at some point such as when diaphragm 65 is fully expanded, the medium will flow through pipe 83 into expandable volume or flexible diaphragm (not shown) of barrier unit 66.

Outlet hole 86 of barrier unit 66 is closed and sealed to prevent any medium from escaping the diaphragm of barrier unit 66 and also from escaping barrier system 100. When the diaphragms of barriers 60, 62, 64, 66 are expanded, their side walls that abut one another will push against each other to form a continuous surface or wall. Thus, barriers 60, 62, 64, 66 will form a rectangular wall that can act as a barrier for large bulk materials and liquids.

One can connect as many barriers as one desires to construct a wall of any length or to create a corral or holding area of any shape. When one connects the barriers, one may seal the barriers together using any conventional technique such as tape, foam or flexible inserts to prevent bulk materials and liquids from seeping between the barriers. In addition, one may seal the area around the base of the barriers to prevent bulk materials and liquids from seeping underneath the barriers. For example, one may embed the barriers in the ground or pile soil or sand against the base of the barriers to form the seal. Moreover, while barrier units having a square planform shape are illustrated as in FIG. 7, the planform area shape can also be triangular, octagonal, hexagonal, parallelogram, oval, circular and the like to permit formation of more complex and varied barriers using barrier units 300 having different shapes attached to by each other by straps or other means as illustrated in FIG. 8.

Figure 8:
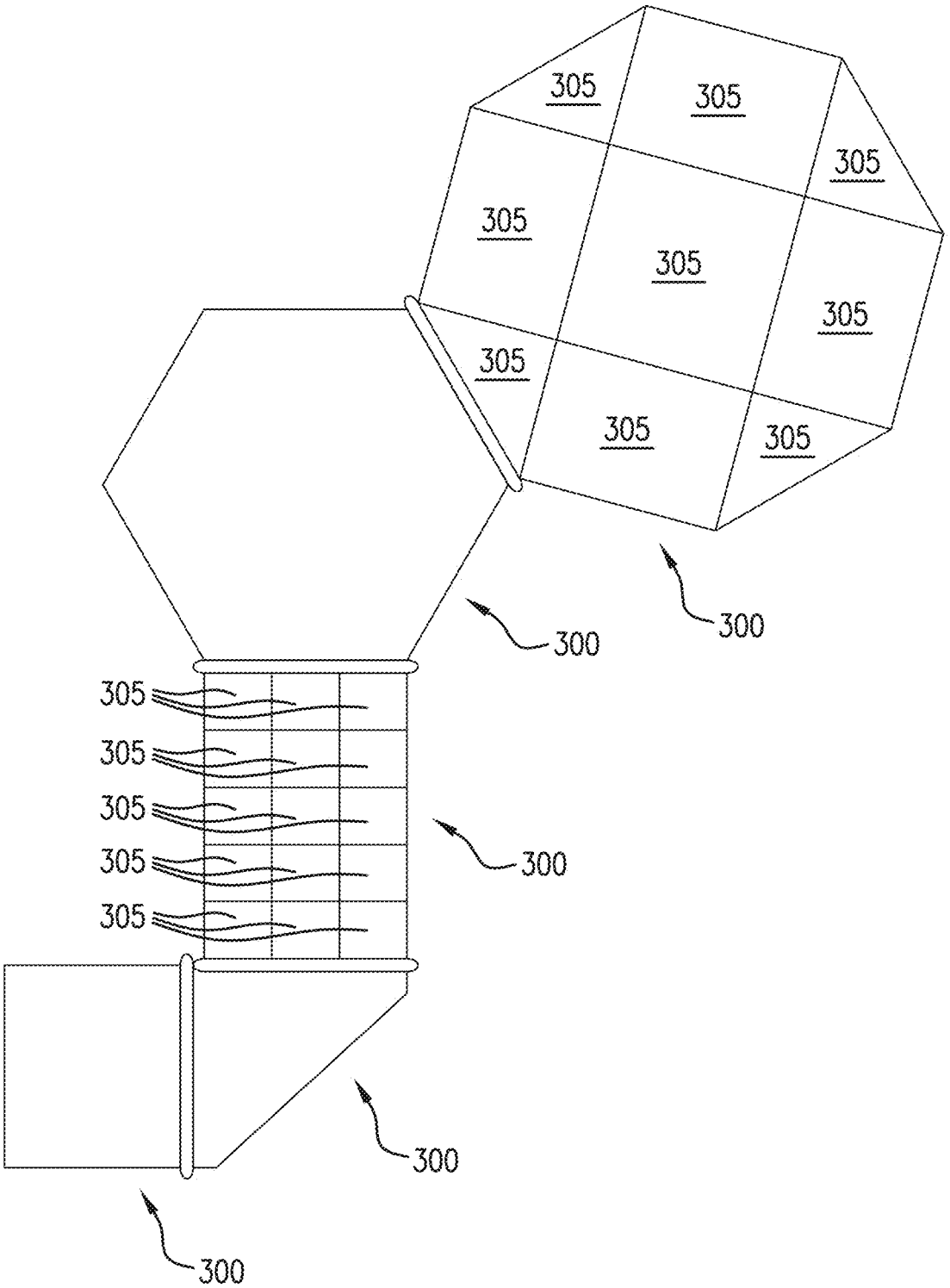
FIG. 8 is a top view of a second arrangement of assembled portable barrier units in accordance with the disclosure having different planform shapes.

In accordance with a further embodiment, as illustrated in FIG. 8, the portable barrier can be composed of a plurality of sub regions, such as tubes or cells 305 in fluid communication with each other that fill when the barrier is filled. Such a barrier construction can limit the degree of bulging of the barrier and maintain suitable alignment between adjacent barriers.

One may connect the inlet and outlet holes of the barriers in any fashion such as in series or in parallel. One may also not connect the inlet and outlet holes of the barriers. In such cases, the outlet holes are closed and the inlet holes are connect to one or more pumps or other devices that supply the medium to expand the diaphragms.

Sample applications of a series of barriers include: connecting a series of barriers together to act as a flood wall or to repair a hole in a levee or to retain bulk materials such as coal or rock salt in a specific area.

Depending on the application, the height of barrier unit 10 may be controlled using the medium or the height is pre-set. In general, the height of barrier unit 10 corresponds to the height of enclosed volume or flexible diaphragm 16's four side walls 48, 50, 52, 54. The height can be adjusted by pumping more or less medium into diaphragm 16. If diaphragm 16 is not fully expanded and is next to another diaphragm that is not fully expanded, then bulk material or liquid may be able to pass between the diaphragms. Therefore, in cases where the diaphragms must be fully expanded, the height of barrier unit 10 will be pre-set by constructing diaphragm 16's four side walls 48, 50, 52, 54 to be a pre-selected height that may be based on factors such as the size of the barrier wall or the amount of bulk material or liquid that needs to be contained.

Figure 9A:
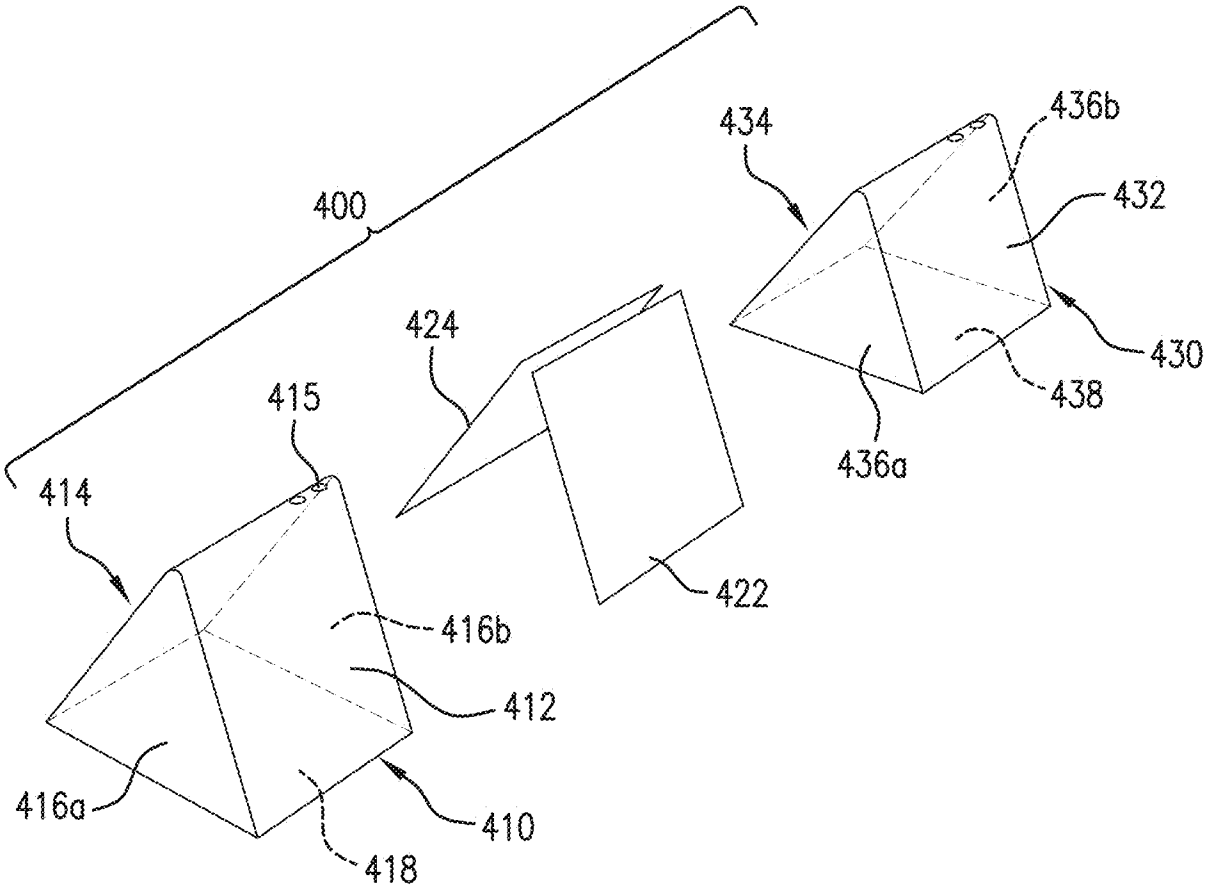
FIGS. 9A-9D illustrate views of further embodiments of a portable barrier in accordance with the disclosure.
Figure 9B:
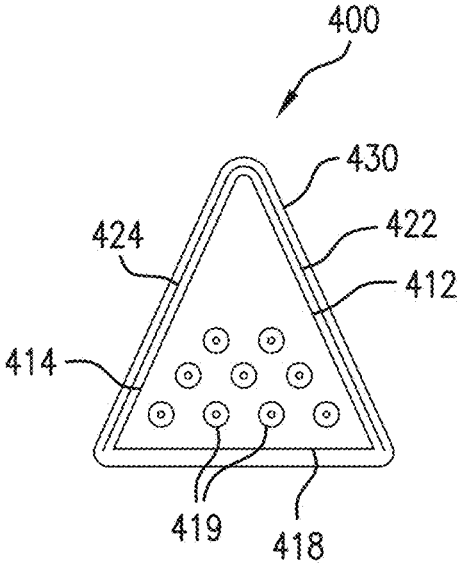
Figure 9C:
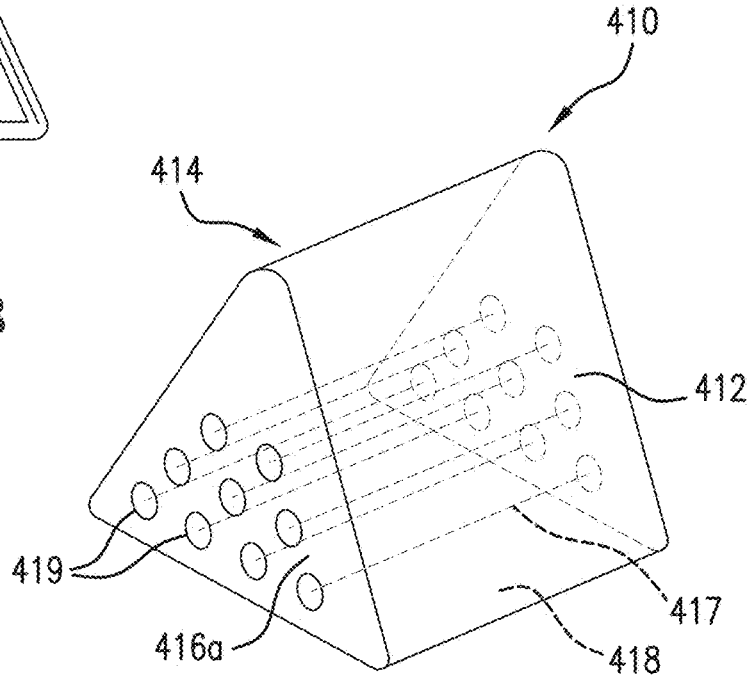

FIGS. 9A-9C illustrate a further embodiment of a portable barrier in accordance with the disclosure. FIG. 9A is an exploded view of the portable barrier, while FIGS. 9*b*-9*c* present schematic views of the portable barrier.

Most notably, the portable barrier of FIGS. 9A-9C have a generally triangular cross section wherein the top of the portable barrier unit coincides with the apex of the triangle.

The particular embodiment illustrated is formed from an inner fluid containing envelope or bladder 410 situated within an outer protective covering 430.

As illustrated in FIG. 9A, inner bladder 410 includes a bottom face 418 that is connected at each of four sides to front and rear triangular panels 416*a*, 416*b* as well as side panels 412, 414. Side panels 412, 414 meet at a top, or apex of the bladder 410 where fill and/or drain valves 415 are situated. In order to prevent the front and rear sides 416*a*/416*b* from bulging outwardly, as illustrated in FIGS. 9B-9C, a plurality of tethers 419 are provided that span between the two panels from a reinforced region 419. The depicted barrier includes nine such reinforcements, but it will be appreciated that any suitable number of reinforcing members may be used. It will also be appreciated that the tethers and reinforced region can be used with any of the disclosed embodiments to help the portable barriers hold a predetermined shape. The tether can include anchor regions proximate the side panels of the barrier and a connecting portion 417 that connects the anchor regions. The connecting portion can be a cord. Alternatively, the tethers can be strips of material that are simply attached to an inner surface of the barrier by various attachment techniques such as ultrasonic welding and the like.

Interposed between the inner envelope 410 and the outer covering 430 are stiffening panels 422, 424 that help the assembly maintain its shape when filled with fluid (e.g., water). The panels can be stitched into the fabric forming the inner bladder 410, may be slid into pockets formed into walls 412, 414, or may otherwise be attached to walls 412, 414. Moreover, if desired, panels 422, 424 may simply be held in place by outer covering 430. Panels such as 422, 424 may be provided with respect to any of the disclosed embodiments to help maintain a predetermined shape.

Outer covering 430 similarly includes a bottom panel 438 that is connected to front and rear triangular panels 436 *a, b* and side panels 432, 434. Outer covering may additionally be provided with straps and sleeves to hold adjacent barriers together as with the embodiment of FIGS. 6-8.

While a barrier with an inner bladder and outer covering are depicted, it will be appreciated that an outer covering and stiffening members is not necessary, and that a variety of techniques can be used to form suitable barriers in accordance with the embodiment of FIG. 9. Of particular advantage, the sloped sides of the barriers help resist an incoming flow of water, such as from a tidal surge, by being bottom heavy and having a sloped surface to resist the incoming force. The barrier of FIG. 9 can be made from any desired materials as described herein. Panels 422, 424 can be made from any suitable material, such as ABS plastic or other suitable polymeric or composite, plywood, steel or other metals, and the like. By virtue of its design, the barrier of FIG. 9 can be stored in a collapsed format wherein the sloped sides come toward each other and the remainder of the barrier can be folded inwardly to rest between the two sides of the barrier.

Portable barriers can be sized in a variety of ways. In accordance with one embodiment, for a water-filled barrier of rectangular or triangular cross section used to block the water, the ratio of width of the cross section (front to back base width) over the height of the cross section can be between about 0.9 and about 0.5. More preferably, the ratio is between about 0.8 and 0.6. Still more preferably it is about 0.7. In another aspect, the ratio is at least about 0.6.

For a water-filled barrier having a rectangular vertical cross section used to block the water, to prevent a rectangular barrier from sliding, the ratio of width of the cross section (b) of the barrier (front to back) over the height of the cross section (h) of the barrier is preferably larger than one-half divided by the friction coefficient (μ), such that $b/h>(1/2)/\mu$. For a water-filled barrier with a triangular vertical cross section used to block the water, preferably $b/h>(2/3)/\mu$. The coefficient of friction between the bottom surface of the barrier and the surface on which it is resting is preferably more than about 0.3, more preferably more than about 0.4, still more preferably more than about 0.5, still more preferably more than about 0.6, and still more preferably more than about 0.7.

Figure 9D:
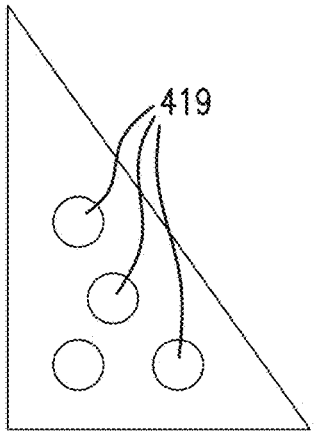

To reduce the use of material and further take advantage of the weight of outside water in stabilizing the water bag, a cross section of a right triangle can be used instead of the symmetrical triangle or the rectangle described hereinabove. A cross section of right triangular shape as applied to a barrier is as shown in FIG. 9D.

For a water bag of right triangular cross section, if the water will be acting on the water bag on the inclined face, the incipient overturning and sliding conditions will be the same as those for the water bag of rectangular cross section. The reason for this is that the water outside and above the inclined face of the water bag is been utilized to stabilize the water bag as well in addition to the water inside the water bag. Thus, for the same depth of water to be blocked, the less material will need to be used to make the water bag of right triangular cross section in comparison to the water bag of rectangular shape, reducing the material cost of the bag.

The right triangular shape also has an advantage over the symmetrical triangular shape in terms of material use since the required base width of the right triangle will be smaller than that of the symmetrical triangle.

The disclosure further provides a wall of portable barrier units wherein the portable barrier units include L-shaped supporting brackets between the portable barrier units to align and support the portable barrier units, each L-shaped supporting bracket having a base portion that extends under the portable barrier units and outwardly behind the wall of portable barrier units and a vertical portion attached to the base portion, wherein wave energy impacting a front of the wall of portable barrier units is absorbed at least in part by the L-shaped supporting brackets by the vertical portion of each bracket deflecting backwardly.

FIG. 10 illustrates yet a further embodiment of a portable barrier in accordance with the disclosure. Specifically, FIG. 10A illustrates a wall 1000 formed from a plurality of aligned portable barriers 1010. An angled bracket 1050 is disposed beneath and behind each portable barrier to help provide alignment and sealing of the portable barrier units 1010. The angled bracket 1050 can be provided in a variety of forms, an example of which is illustrated in FIG. 10A. As illustrated, the angled bracket can include generally planar front 1052 and rear 1054 base plate portions having upper and lower planar surfaces, longitudinal side edges, and front and back edges that are attached to a vertical portion 1056 at a joint 1060. As illustrated, the vertical portion 1056 includes a plate shaped member having opposing front and back surfaces facing toward the portable barriers and away from the portable barriers, respectively, vertically oriented longitudinal edges, and upper and lower end edges. The joint 1060 can be a static (e.g., welded) joint, or can be a mechanical or natural hinge-type connection. An example of a mechanical hinge 1072 is illustrated in FIG. 10C. One or more braces 1058 can be attached to the rearward face of the vertical portion 1056 and the upper face of the rear base plate portion 1054 that is either static and attached (e.g., welded) in place, or one that may include a spring and/or shock absorber 1059. As illustrated in FIG. 10B, if desired, bracket 1050 can include a web bracket portion 1062 that rests between the barriers 1010 and provides extra resistance to backward bending of vertical portion 1056 when, for example, a wave or other force acts against the opposite side of the wall 1000 of portable barriers 1010. In use, the brackets 1050 are held in place by the weight of the barriers 1010 (but may also be staked down or otherwise attached to the ground). Part of the force acting on the face of the barrier wall is transmitted to bracket 1050, which may deflect temporarily to absorb the energy of the force. If desired, spring or shock absorber 1059 can similarly provide a sink for the energy. As will be appreciated, the bracket need not have a rear base portion, such as embodiment 1050A. The brackets 1050 can be made from metal, plastic, wood, composite materials and the like or combinations thereof, and may be formed from discrete components or can be formed as a unitary monolithic structure. If desired, adjacent brackets 1050 can be tethered or bolted together by upper and lower horizontal braces attached to the upper and lower ends of the brackets 1050 (not shown) and/or "X"-shaped cross bracing connected to the upper and lower ends of adjacent brackets 1050 (not shown).

The purpose of the foregoing description of the preferred embodiments is to provide illustrations of the embodiments described herein. The foregoing description is not intended to be exhaustive or to limit the disclosure to the precise forms disclosed. One of skill in the art will obviously understand many modifications and variations are possible in light of the above principles. The foregoing description explains those principles and examples of their practical applications. The foregoing description is not intended to limit the scope of the inventions that are defined by the claims below.

What is claimed is:

1. A wall of filled portable fillable barrier units arranged in a side by side format, the wall comprising:

a) a plurality of filled barrier units, each barrier unit having a base and a plurality of walls, and including:
   i) a collapsible inner envelope defining a volume that is removably filled with a material to weight the barrier unit down, the collapsible inner envelope including a tether spanning across the inner envelope, the tether being configured to help the inner envelope maintain a shape; and
   ii) at least one rigid element configured to collapse with the inner envelope upon disassembly at least partially protecting the inner envelope and helping the inner envelope maintain the shape; and b) a plurality of alignment and reinforcing brackets, each bracket being disposed between adjacent barrier units, each alignment and reinforcement bracket having a lower portion that is disposed below the adjacent barrier units, and an upwardly extending portion that extends behind the adjacent barrier units, the alignment and reinforcing brackets providing additional resistance to a force imparted on a front side of the wall.

2. The wall of claim 1, wherein the brackets include generally planar front and rear base plate portions having upper and lower planar surfaces, longitudinal side edges, and front and back edges that are attached to the upwardly extending portion at a joint.

3. The wall of claim 2, wherein the upwardly extending portion includes a plate shaped member having opposing front and back surfaces facing toward the portable barriers and away from the portable barriers.

4. The wall of claim 2, wherein the joint is a static joint.

5. The wall of claim 2, wherein the joint is a mechanical hinge.

6. The wall of claim 2, wherein the joint is a natural hinge.

7. A wall of filled portable fillable barrier units arranged in a side by side format, the wall comprising:

a) a plurality of filled barrier units, each barrier unit having a base and a plurality of walls, and including:
   i) an inner envelope defining a volume that is removably filled with a material to weight the barrier unit down; and
   ii) an outer covering at least partially surrounding the inner envelope; and b) a plurality of alignment and reinforcing brackets, each bracket being disposed between adjacent barrier units, each alignment and reinforcement bracket having a lower portion that is disposed below the adjacent barrier units, and an upwardly extending portion that extends behind the adjacent barrier units, the alignment and reinforcing brackets providing additional resistance to a force imparted on a front side of the wall;

wherein the lower portion is connected to the upwardly extending portion by a natural or mechanical hinge, and a shock absorber that absorbs shocks transmitted by the upwardly extending portion.

8. The wall of claim 1, wherein at least one of the lower portion and upwardly extending portion includes a web bracket portion that rests between adjacent barriers.

9. The wall of claim 1, wherein the barriers are configured to be staked down.

10. The wall of claim 1, wherein the brackets are monolithic structures.

11. The wall of claim 1, wherein the brackets are formed at least in part from wood.

12. The wall of claim 1, wherein the brackets are formed at least in part from metal.

13. The wall of claim 1, wherein the at least one rigid element includes at least one of a base, a top and a stiffening panel.

14. The wall of claim 1, wherein the at least one rigid element is configured to collapse with the inner envelope upon removal of the material from the inner envelope.

15. The wall of claim 7, wherein the brackets include generally planar front and rear base plate portions having upper and lower planar surfaces, longitudinal side edges, and front and back edges that are attached to the upwardly extending portion at a joint.

16. The wall of claim 15, wherein the upwardly extending portion includes a plate shaped member having opposing front and back surfaces facing toward the portable barriers and away from the portable barriers.

17. The wall of claim 7, wherein at least one of the lower portion and upwardly extending portion includes a web bracket portion that rests between adjacent barriers.

18. The wall of claim 7, wherein the barriers are configured to be staked down.

19. The wall of claim 7, wherein the brackets are monolithic structures.

20. The wall of claim 7, wherein the brackets are formed at least in part from wood.

21. The wall of claim 7, wherein the brackets are formed at least in part from metal.

* * * * *